US012188466B2

(12) United States Patent
Hopkins et al.

(10) Patent No.: US 12,188,466 B2
(45) Date of Patent: Jan. 7, 2025

(54) PUMP FOR ARTICLE OF FOOTWEAR OR APPAREL

(71) Applicant: NIKE, Inc., Beaverton, OR (US)

(72) Inventors: Timothy P. Hopkins, Lake Oswego, OR (US); Nicholas R. Long, Portland, OR (US); Todd W. Miller, Portland, OR (US); Matthew D. Nordstrom, Portland, OR (US); Austin J. Orand, Portland, OR (US); Richard Kristian Hansen, Camas, WA (US); Kimberly A. Sokol, Beaverton, OR (US)

(73) Assignee: NIKE, Inc.

( * ) Notice: Subject to any disclaimer, the term of this patent is extended or adjusted under 35 U.S.C. 154(b) by 124 days.

(21) Appl. No.: 17/816,267

(22) Filed: Jul. 29, 2022

(65) Prior Publication Data

US 2023/0033238 A1 Feb. 2, 2023

Related U.S. Application Data

(60) Provisional application No. 63/228,402, filed on Aug. 2, 2021.

(51) Int. Cl.

| | |
|---|---|
| ***F04B 45/06*** | (2006.01) |
| ***A41D 1/00*** | (2018.01) |
| ***A43B 3/26*** | (2006.01) |

(52) U.S. Cl.

CPC ..... *F04B 45/06* (2013.01); *A41D 1/00* (2013.01); *A43B 3/26* (2013.01)

(58) Field of Classification Search

CPC ..... F04B 45/06; F04B 45/02; F04B 33/00; F04B 43/08; F04B 43/084; A41D 1/00; A43B 3/26

See application file for complete search history.

(56) References Cited

U.S. PATENT DOCUMENTS 2,947,470 A * 8/1960 Ruben ..... A61M 1/82 604/134
3,861,217 A * 1/1975 Rabenecker ..... F04B 9/12 73/864.34

(Continued)

FOREIGN PATENT DOCUMENTS

EP 3506781 A1 7/2019
KR 101404716 B1 6/2014

OTHER PUBLICATIONS

European Patent Office (ISA), International Search Report and Written Opinion for App. No. PCT/US2022/074323, mailed Nov. 18, 2022.

*Primary Examiner* — Bryan M Lettman
(74) *Attorney, Agent, or Firm* — Honigman LLP; Matthew H. Szalach; Jonathan P. O'Brien

(57) ABSTRACT

A pump includes a conduit defining an inner volume and formed from a flexible material, the conduit movable between an expanded state and a relaxed state. A coil is disposed within the conduit and includes an outer diameter that is approximately equal to an inner diameter of the conduit, the coil substantially maintaining its outer diameter when the conduit is moved between the relaxed state and the expanded state. A manifold is in fluid communication with the inner volume and is operable to permit fluid to enter the inner volume in a first mode and expel fluid from the inner volume in a second mode.

20 Claims, 10 Drawing Sheets

(56) References Cited

U.S. PATENT DOCUMENTS

| | | | | |
|---|---|---|---|---|
| 4,338,826 | A * | 7/1982 | Jacoby | G01N 1/24 73/864.62 |
| 4,858,478 | A * | 8/1989 | Kush | G01N 1/24 417/63 |
| 5,222,312 | A | 6/1993 | Doyle | |
| 6,287,095 | B1 * | 9/2001 | Saputo | A47C 27/084 417/472 |
| 7,784,196 | B1 | 8/2010 | Christensen et al. | |
| 2017/0215516 | A1 * | 8/2017 | Silva | A43C 11/008 |

* cited by examiner

PUMP FOR ARTICLE OF FOOTWEAR OR APPAREL

CROSS REFERENCE TO RELATED APPLICATIONS

This application claims priority under 35 U.S.C. § 119(e) to U.S. Provisional Application No. 63/228,402, filed on Aug. 2, 2021. The disclosure of this prior application is considered part of the disclosure of this application and is hereby incorporated by reference in its entirety.

FIELD

The present disclosure relates generally to a pump and more particularly to a pump for an article of footwear or apparel.

BACKGROUND

This section provides background information related to the present disclosure and is not necessarily prior art.

Articles of apparel, such as garments and headwear, and articles of footwear, such as shoes and boots, typically include a receptacle for receiving a body part of a wearer. For example, an article of footwear may include an upper and a sole structure that operate to form a receptacle for receiving a foot of a wearer. Likewise, garments and headwear may include one or more pieces of material formed into a receptacle for receiving a torso or head of a wearer.

Articles of apparel or footwear are typically adjustable and/or include a relatively flexible material to allow the article of apparel or footwear to accommodate various sizes of wearers, or to provide different fits on a single wearer. While conventional articles of apparel and articles of footwear are adjustable, such articles typically require a wearer to secure the article by lacing or other means. For example, while laces adequately secure an article of footwear to a wearer by contracting or constricting a portion of an upper around the wearer's foot, the laces do not cause the upper to lock in a size or shape conforming to the user's foot. Accordingly, an optimum fit of the upper around the foot is difficult to achieve.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1A:
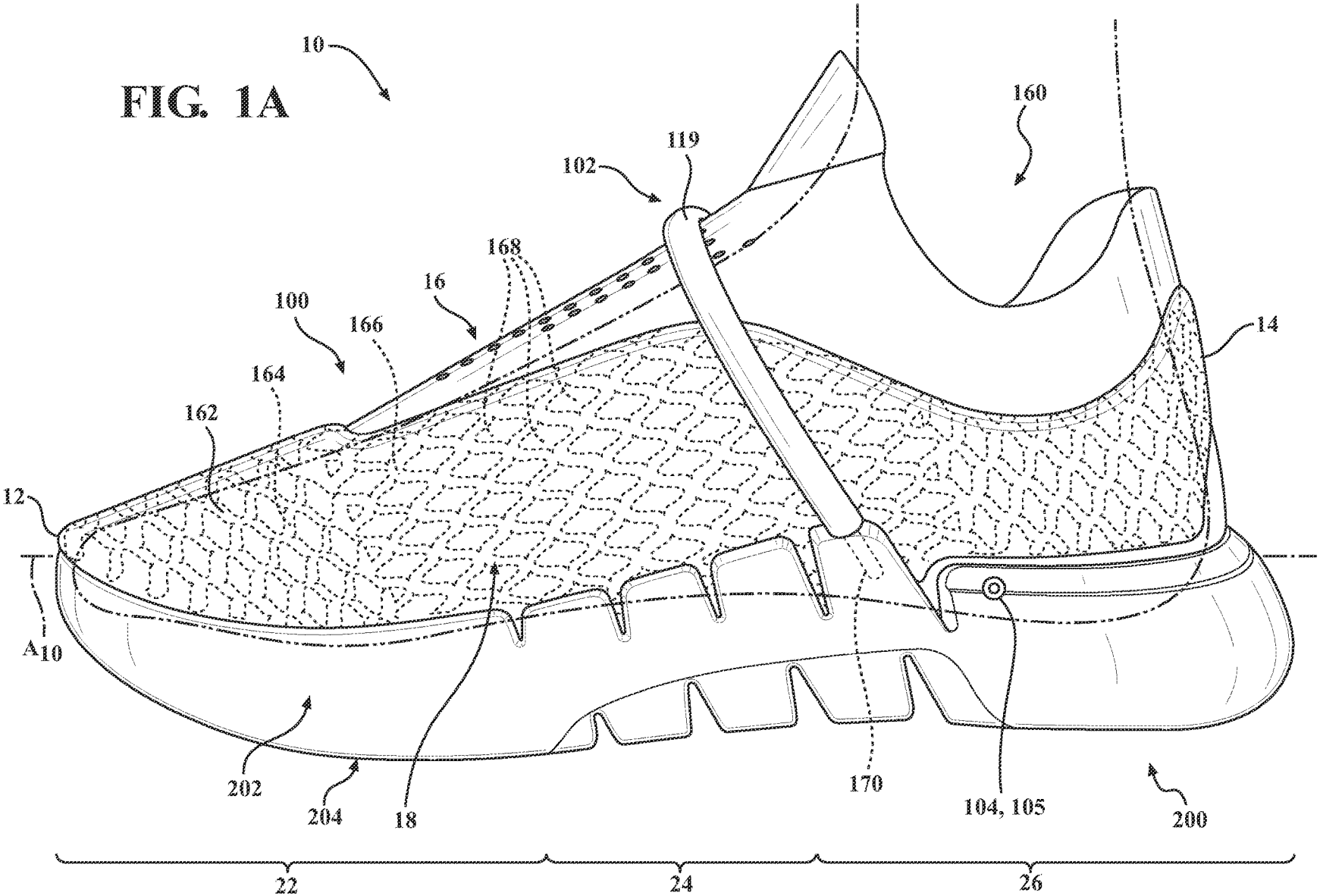
FIG. 1A is a lateral side perspective view of an article of footwear incorporating a pump according to an example of the present disclosure, where the article of footwear is in a relaxed state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a pump is provided an includes a conduit defining an inner volume and formed from a flexible material, the conduit movable between an expanded state and a relaxed state. A coil is disposed within the conduit and includes an outer diameter that is approximately equal to an inner diameter of the conduit, the coil substantially maintaining its outer diameter when the conduit is moved between the relaxed state and the expanded state. A manifold is in fluid communication with the inner volume and is operable to permit fluid to enter the inner volume in a first mode and expel fluid from the inner volume in a second mode.

The pump may include one or more of the following optional features. For example, the coil may be formed from a different material than a material forming the conduit. Namely, the coil could be formed from a foam material. Additionally or alternatively, the coil may include a helical shape.

In one configuration, the coil may define a passageway formed therethrough. The passageway may include a longitudinal axis that is substantially parallel to a longitudinal axis of the coil. Additionally or alternatively, the manifold may include a first valve permitting fluid flow into the inner volume and preventing fluid flow out of the inner volume in the first mode and a second valve permitting fluid flow out of the inner volume and preventing fluid flow into the inner volume in the second mode. At least one of the first valve and the second valve may be a check valve.

An article of footwear may incorporate the pump.

An article of apparel may incorporate the pump.

In another configuration, a pump is provided and includes a conduit defining an inner volume and movable between an expanded state and a relaxed state, an effective length of the conduit being increased when moved from the relaxed state to the expanded state. A coil is disposed within the conduit, includes an outer diameter that is approximately equal to an inner diameter of the conduit, and has an effective length that is increased when the conduit is moved from the relaxed state to the expanded state, the coil substantially maintaining its outer diameter when the conduit is moved between the relaxed state and the expanded state. A manifold is in fluid communication with the inner volume and is operable to permit fluid to enter the inner volume in a first mode and expel fluid from the inner volume in a second mode.

The pump may include one or more of the following optional features. For example, the coil may formed from a different material than a material forming the conduit. Namely, the coil could be formed from a foam material. Additionally or alternatively, the coil may include a helical shape.

In one configuration, the coil may define a passageway formed therethrough. The passageway may include a longitudinal axis that is substantially parallel to a longitudinal axis of the coil. Additionally or alternatively, the manifold may include a first valve permitting fluid flow into the inner volume and preventing fluid flow out of the inner volume in the first mode and a second valve permitting fluid flow out of the inner volume and preventing fluid flow into the inner volume in the second mode. At least one of the first valve and the second valve may be a check valve.

An article of footwear may incorporate the pump.

An article of apparel may incorporate the pump.

The details of one or more implementations of the disclosure are set forth in the accompanying drawings and the description below. Other aspects, features, and advantages will be apparent from the description, the drawings, and the claims.

Figure 1B:
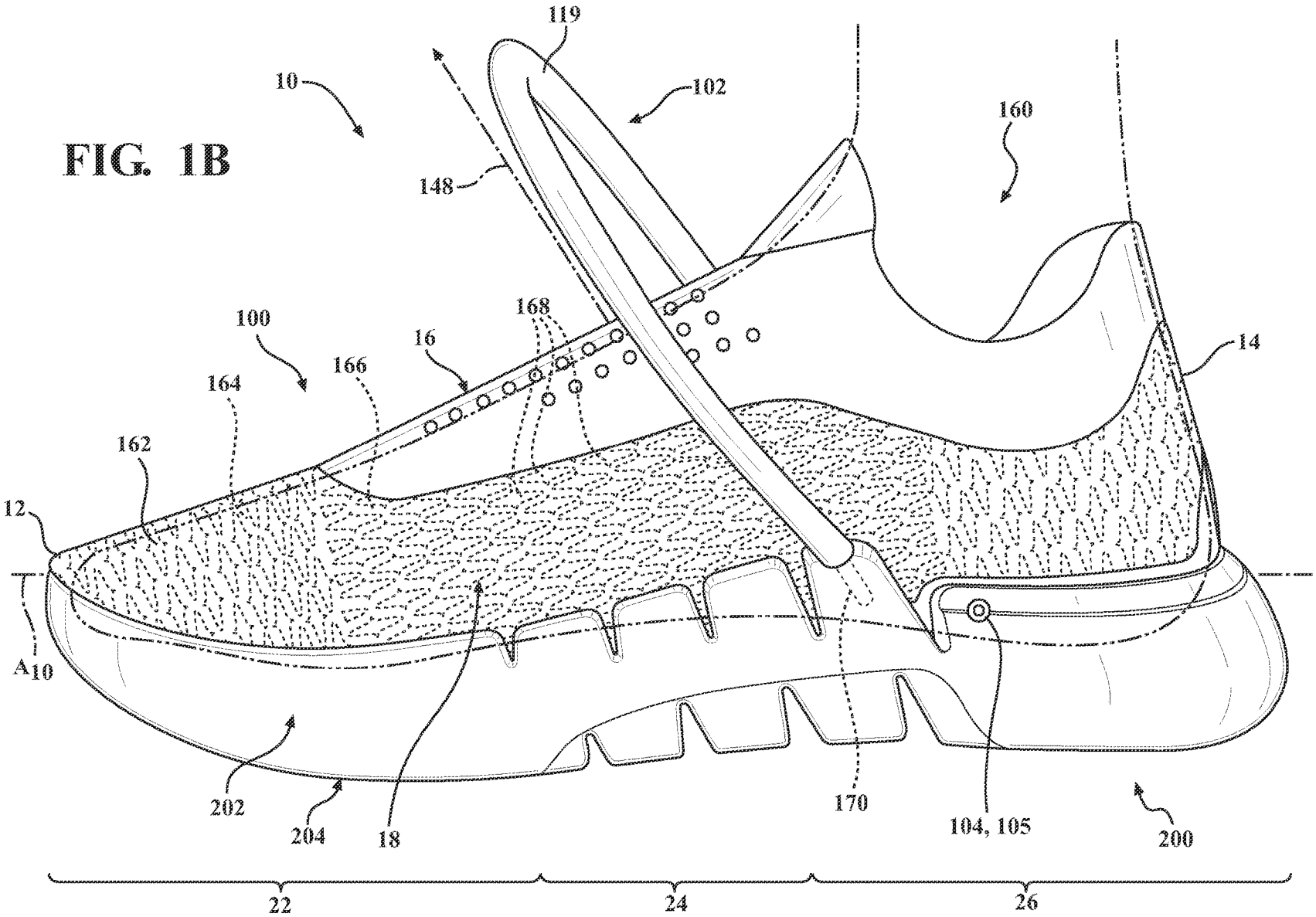
FIG. 1B is a lateral side perspective view of the article of footwear of FIG. 1A, where the article of footwear is in a constricted state.
Figure 2:
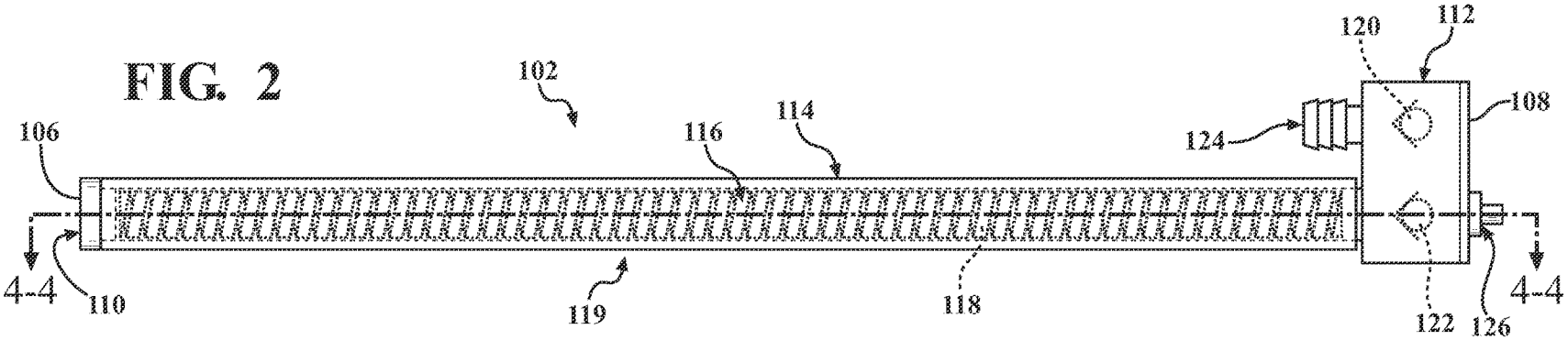
FIG. 2 is a perspective view of a pump in accordance with the principles of the present disclosure.

Referring to FIGS. 1A and 1B, an article of footwear 10 includes an upper 100 and a sole structure 200 attached to the upper 100. The article of footwear 10 may further include an anterior end 12 associated with a forward-most point of the footwear 10, and a posterior end 14 corresponding to a rearward-most point of the footwear 10. A longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

The article of footwear 10 may be divided into one or more regions. The regions may include a forefoot region 22, a mid-foot region 24, and a heel region 26. The forefoot region 22 may correspond with the phalanges and the metatarsal bones of a foot. The mid-foot region 24 may correspond with an arch area of the foot, and the heel region 26 may correspond with rear portions of the foot, including a calcaneus bone.

As shown, the sole structure 200 includes a midsole 202 configured to provide cushioning and support and an outsole 204 defining a ground-engaging surface of the sole structure 200. In other examples, the midsole 202 may be configured as a composite structure including a plurality of components joined together. Stitching or adhesives may secure the midsole 202 to the upper 100, while a bottom surface of the outsole 204 defines a ground-engaging surface of the sole structure 200.

The article of footwear 10 may further include a pump 102 and a release valve 104. The pump 102 extends across the upper 100 and may be in fluid communication with the upper 100 through one or more valves to adjust a pressure in the upper 100 from a first pressure (e.g., at or above ambient) to a second pressure (e.g., below ambient) by removing fluid (e.g., a gas or liquid) from the upper 100. The release valve 104 may be fluidly coupled to the upper 100 and serves to selectively permit fluid to enter the upper 100 to return the upper 100 to the first pressure. As discussed in greater detail below, the pump 102 and the release valve 104 cooperate to transition the upper 100 between a relaxed state (FIG. 1A) and a constricted state (FIG. 1B).

Referring to FIGS. 2-4B and 7A-7C, the pump 102 includes a first end 106 coupled to the article of footwear 10 and a second end 108 coupled to the article of footwear 10 and disposed on an opposite end of the pump 102 than the first end 106. The pump 102 further includes an endcap 110 disposed at the first end 106, a manifold 112 disposed at the second end 108, and an outer tube 114 extending between and connecting the endcap 110 and the manifold 112 to enclose a chamber 116 defined by the pump 102. The pump 102 further includes a pump core 118 sized to be received by the chamber 116. The pump core 118 substantially fills the outer tube 114 and extends between the endcap 110 and the manifold 112. When assembled, the outer tube 114 and the coil 118 further define an actuator cable 119.

The endcap 110 and the manifold 112 may include any suitable lightweight material, such as nylon (PA), polypropylene (PP), carbon, or an aluminum alloy. The outer tube 114 may include rubber, latex, butyl, silicone, or any other tubing that is highly elastic and retains its properties under a high number of cycles. The pump core 118 may include a flexible material such as a PP, PA, thermoplastic polyurethane (TPU), rubber, closed cell foam, BRSX, or any other material that retains its properties under a high number of cycles. When the pump 102 is assembled, the chamber 116 desirably has a low gas transmission rate to preserve its retained gas pressure. The endcap 110, manifold 112, and outer tube 114 may be secured together by compression fit, adhesive, or by any other external securing means.

The manifold 112 includes an inlet check valve 120 configured to selectively allow fluid to flow into the chamber 116, and an exhaust check valve 122 configured to selectively permit fluid to flow out of the chamber 116. The inlet check valve 118 may further include an intake port 124 connecting the inlet check valve 120 of the pump 102 to the upper 100, and an exhaust port 126 connecting the exhaust check valve 122 of the pump 100 to the outside air (e.g., ambient).

Figure 3:
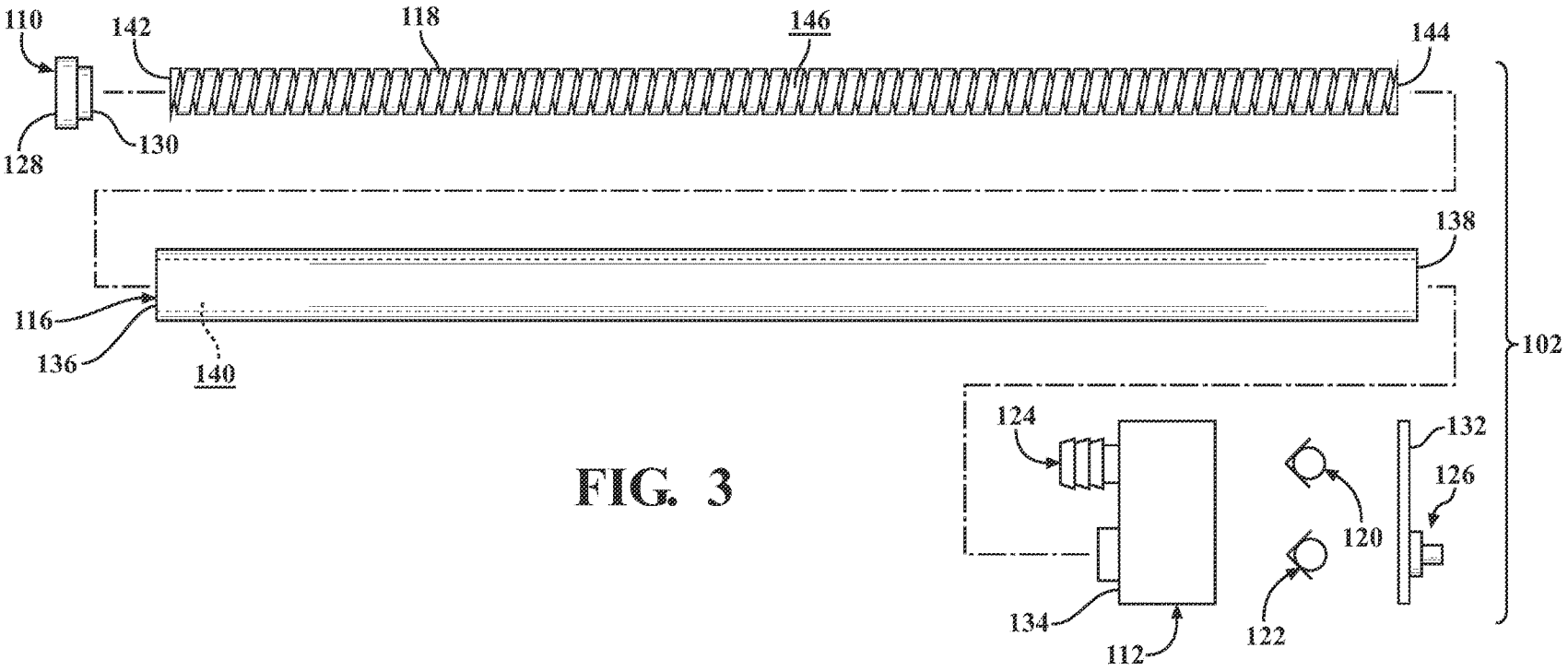
FIG. 3 is an exploded view of the pump of FIG. 2.

With continued reference to FIG. 3, the endcap 110 is defined by an outer end 128 corresponding to the first end 106 of the pump 102, and an inner end 130 formed on an opposite side of the endcap 110 than the outer end 128 and facing the outer tube 114. The manifold 112 is further defined by an outer end 132 corresponding to the second end 108 of the pump 102, and an inner end 134 formed on an opposite side of the manifold 112 than the outer end 132 and facing the outer tube 114. The outer tube 114 is defined by a first end 136 facing the inner end 130 of the endcap 110, a second end 138 formed on an opposite side of the outer tube 114 than the first end 136 and facing the inner end 134 of the manifold 112, and an inner surface 140.

In the illustrated example, the pump core 118 includes a coil 118 extending from a first end 142 coupled to the inner end 130 of the endcap 110, to a second end 144 coupled to the inner end 134 of the manifold 112. The coil 118 may further include an outer surface 146 defining the outer diameter of the coil 118. In some implementations, one or both of the first end 142 and the second end 144 are fully detached from the inner end 130 of the endcap 110 and the inner end 134 of the manifold 112.

The coil 118 is disposed within the chamber 116 of the pump 102 and, with the outer tube 114, forms a transformable structure (i.e., the actuator cable 119) operable to transition the pump 102 between a relaxed state and a stretched state. When the pump 102 is assembled, the outer surface 146 of the coil 118 faces the inner surface 140 of the outer tube 114, and may be attached to the inner surface 140. Thus, as the outer tube 114 moves between the relaxed state and the stretched state, the inner surface 140 of the outer tube 114 directly pulls the coil 118 to transition the coil 118 from the relaxed state to the stretched state.

In other examples, the outer surface 146 of the coil 118 may be fully detached from the inner surface 140 of the outer tube 114. In this configuration, the coil is free to slide with respect to the inner surface 140 of the outer tube as the outer tube 140 of the pump 102 transitions between the relaxed state and the stretched state. Here, the outer surface 146 of the coil 118 may be indirectly influenced into the relaxed and stretched states by the outer tube 114. Alternatively, the outer surface 146 of the coil 118 may be zonally attached to the inner surface 140 of the outer tube 114 and/or may be attached at the ends 142, 144.

Figure 4A:
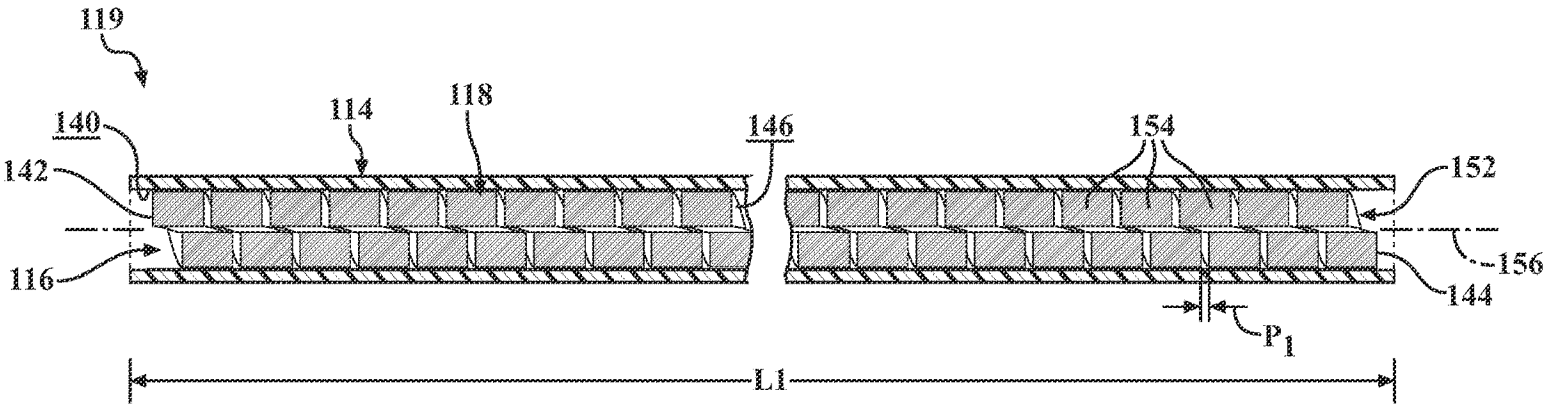
FIG. 4A is a cross-sectional view of the pump of FIG. 2, taken along line 4-4 in FIG. 2, where the pump is in a first configuration.
Figure 4B:
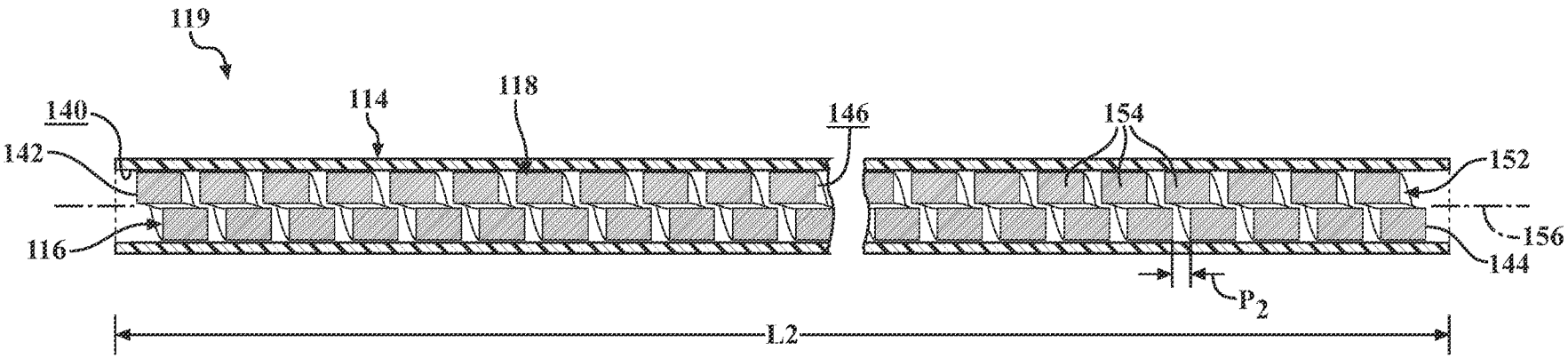
FIG. 4B is a cross-sectional view of the pump of FIG. 2, taken along line 4-4 in FIG. 2, where the pump is in a second configuration.

Referring to FIGS. 4A and 4B, the actuator cable 119 including the outer tube 114 and the coil 118 is shown. The coil 118 is further defined by a continuous elongated member 152 arranged in a helical manner to define a plurality of threads 154, a coil pitch P between opposing threads 154, and a through-hole 156 extending axially from the first end 142 to the second end 144 of the coil 118. Generally, as the pump 102 transitions from the relaxed state to the stretched state, the coil 118 is configured to maintain its diametric dimension while extending axially. In other words, the continuous elongated member 152 maintains a generally consistent cross-section (i.e., thickness) while the coil pitch P between each opposing threads 154 changes while in the relaxed state and the stretched state. Consequently, the coil 118 prevents the outer tube 114 from collapsing when the pump 102 moves between the relaxed state and the stretched state. In some implementations, the coil 118 may not include a through-hole 156, to further fill the outer tube 114 in the relaxed state. Examples of different geometries of the coil 118 are discussed below with respect to FIGS. 5A-6C.

The outer tube 114 and the coil 118 are configured to stretch when a force is applied to the actuator cable 119 (i.e., the actuator cable 119 is pulled in a tightening direction 148). Due to the resiliency of the outer tube 114 and the coil 118, the actuator cable 119 returns to a resting length when released. Accordingly, the actuator cable 119 is operable to actuate the outer tube 114 and the coil 118 between a first position associated with a first length L1 where the outer tube 114 and the coil 118 are in a resting state (FIG. 4A), and a second position associated with a second length L2 where the outer tube 114 and the coil 118 are in a stretched state (FIG. 4B). Additionally, the first position is associated with a first pitch P1 (FIG. 4A) of the coil 118, and the second position is associated with a second pitch P2 (FIG. 4B) of the coil 118, where the second pitch P2 is a greater distance between the threads 154 of the elongated member 152 than the first pitch P1. When the actuator cable 119 is in the first position, the first pitch P1 may allow the coil 118 to substantially fill the outer tube 114. As the actuator cable 119 is actuated into the second position, the coil 118 stretches axially, increasing the pitch from the first pitch P1 to the second pitch P2, which allows air to be drawn into the chamber 116 of the pump 102 by substantially maintaining an inner diameter of the outer tube 114 while still substantially filling the outer tube 114. Consequently, and as discussed below, cycling the actuator cable 119 between the first position and the second position operates to draw fluid in through the intake port 124 and exhaust fluid out through the exhaust port 126 when the force is released. This is accomplished by the coil 118 causing the outer tube 114 to maintain its diameter as the length of the outer tube 114 is increased due to the force exerted thereon. The increased length of the tube 114 along with it maintaining its relaxed diameter during elongation causes an internal volume of the tube 114 to increase, thereby causing fluid to be drawn into the tube 114 via the intake port 124.

Referring now to FIGS. 5A-6C, various geometries of coils 118*a*-118*c* are illustrated. As discussed above, the outer tube 114 is sized to receive the coil 118. Accordingly, the geometry of coil 118*a*-118*c* will dictate the geometry of its corresponding outer tube 114. The coils 118*a*-118*c* are defined by a continuous elongated member 152 arranged in a helical manner. This arrangement forms the plurality of threads 154*a*-154*c* defining the coil pitches $P_a$-$P_c$ between opposing threads 154*a*-154*c*, and the through-holes 156*a*-156*c* extending axially from the first end 142 to the second end 144 of the coils 118*a*-118*c*. Each of the coils 118*a*-118*c* may further be defined by a corresponding cross-sectional area 158*a*-158*c*.

Figure 5C:
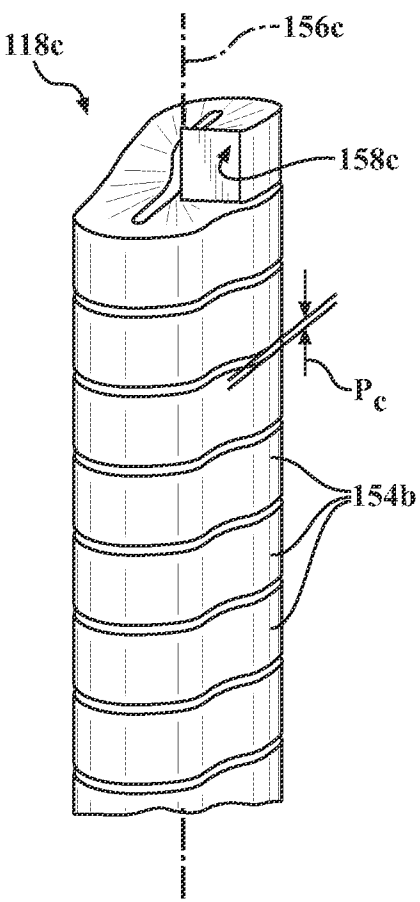
FIGS. 5A-5C show example coils for the pump according to the present disclosure.
Figure 5B:
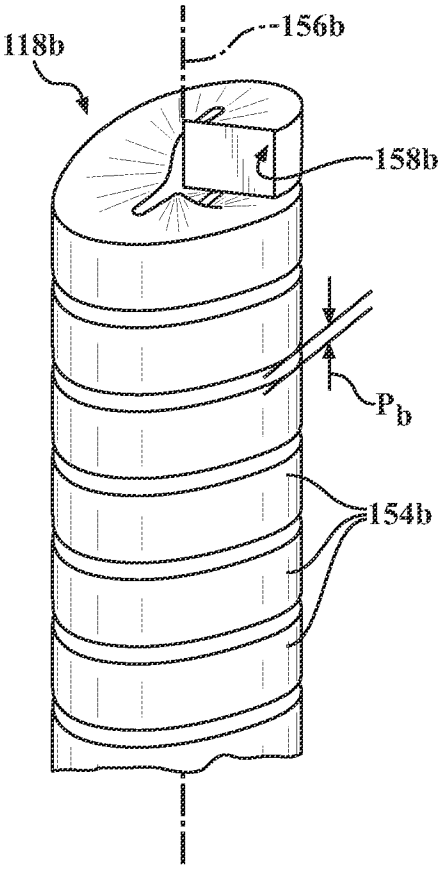
Figure 5A:
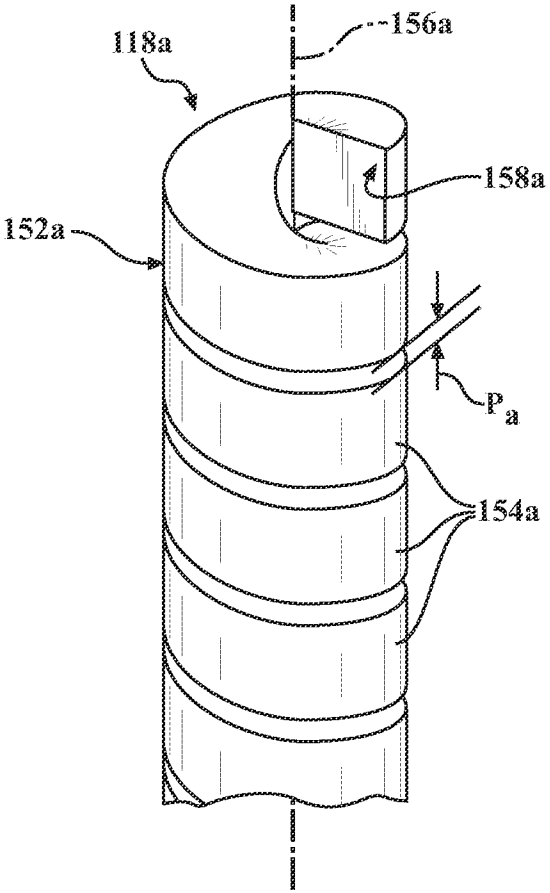
Figure 6B:
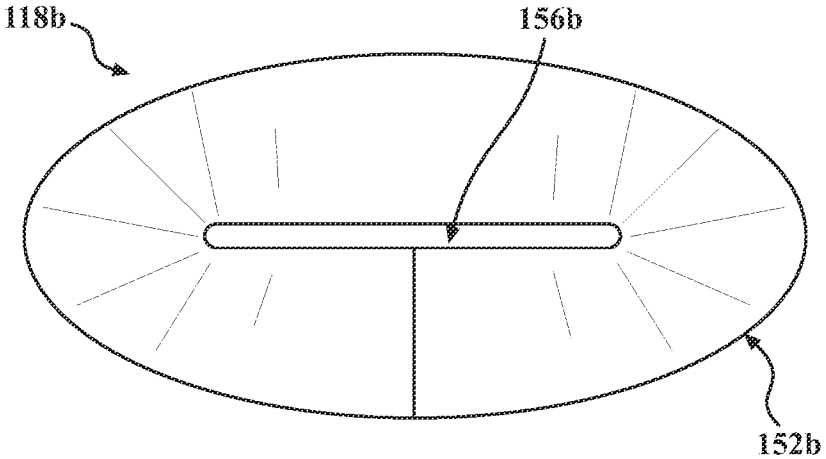
FIGS. 6A-6C are top perspective views of the example coils of FIGS. 5A-5C.
Figure 6A:
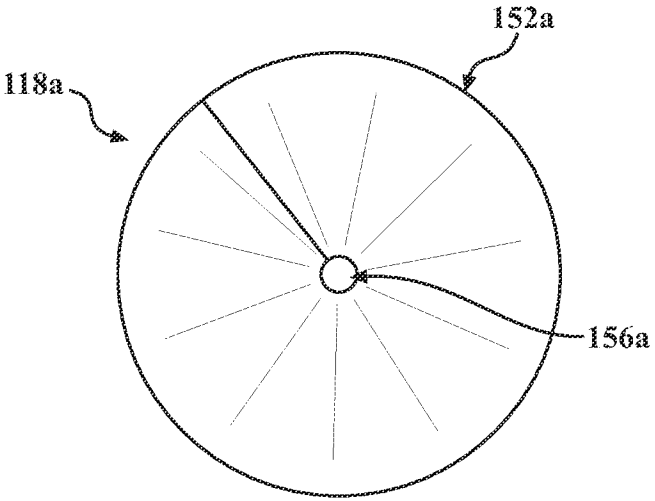
Figure 6C:
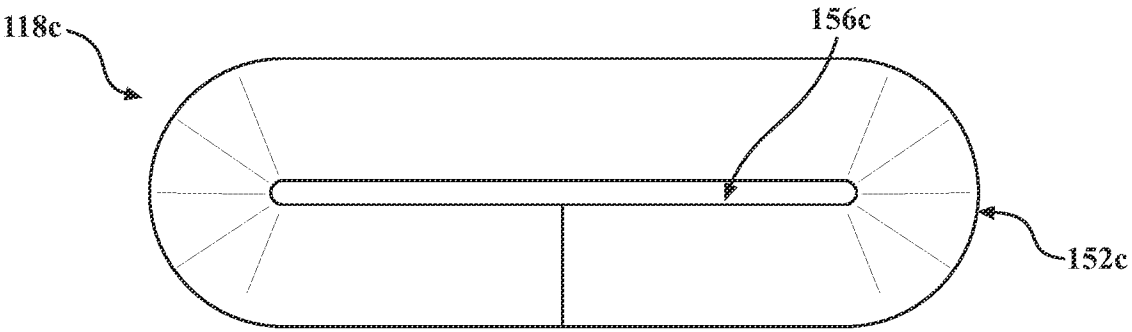

For example, FIGS. 5A and 6A show a coil 118*a* that includes a helical continuous elongated member 152*a* in a circle-shape (i.e., circular helix). In these examples, the cross-sectional area 158*a* is shaped in a square shape, and wraps around the through-hole 156*a* to form threads 154*a* separated by coil pitches $P_a$. As shown, the through-hole 156*a* is also circle-shaped to correspond to the circle shape of the coil 118*a*. Alternatively, a coil 118*b* includes a helical continuous elongated member 152*b* in an oval shape (FIGS. 5B and 6B). In these implementations, the cross-sectional area 158*b* is shaped in a rectangular shape, and wraps around the through-hole 158*b* to form threads 154*b* separated by coil pitches $P_b$. As shown, the through-hole 156*b* is generally shaped as an elongated slot having a pair of rounded ends and substantially straight intermediate portions. In some examples, (FIGS. 5C and 6C), a coil 118*c* includes a helical continuous elongated member 152*c* in an elongated slot shape having a pair of rounded ends and substantially straight intermediate portions. In these examples, the cross-sectional area 158*c* is shaped in a rectangular shape, and wraps around the through-hole 158*c* to form threads 154*c* separated by coil pitches $P_c$. As shown, the through-hole 156*c* is generally shaped as an elongated slot having a pair of rounded ends and substantially straight intermediate portions.

Referring briefly to FIGS. 1A and 1B, the upper 100 may be formed from one or more materials that are stitched or adhesively bonded together to define an interior void 160. Suitable materials of the upper 100 may include, but are not limited to, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the article of footwear 10 between the constricted state and the relaxed state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

In the illustrated example, the upper 100 includes one or more fluid chambers 162 in fluid communication with the pump 102. Each of the chambers 162 includes a compressible component 164 disposed therein that compresses as the upper 100 transitions from the relaxed state (FIG. 1A) to the constricted state (FIG. 1B). The compressible component 164 may include a lattice structure 166 defining a plurality of reliefs 168 (e.g., openings). As discussed above with reference to FIGS. 1A and 1B, the pump 102 is in fluid communication with the chambers 162 of the upper 100. In these implementations, an intake conduit 170 connects the intake port 124 including the inlet check valve 120 to the chambers 162 of the upper 100 allowing fluid communication between the pump 102 and the upper 100. In some implementations, the release valve 104 includes a release valve 105 including a Schrader valve that is selectively activated by the release valve 104 to allow outside air (e.g., ambient) to enter the upper 100 to return the upper 100 to a relaxed state from a constricted state.

In use, the pressure within the chambers 162 of the upper 100 is reduced by drawing a vacuum within the chambers 162 of the upper 100 via the pump 102. As the pressure is reduced, the upper 100 moves from a relaxed state to a constricted state that forms the upper 100 around the wearer's foot. Thus, as the vacuum is drawn by cycling the pump 102, as described below with respect to FIGS. 7A-8C, fluid is drawn from within the chambers 162 of the upper 100 and into the chamber 116 of the pump 102 to compress the lattice structure 166 of the compressible component 164, thereby constricting the upper 100 around the foot of the wearer. When the release valve 104 is actuated, the lattice structure 166 of the compressible component 164 expands within each chamber 162, thereby causing an internal volume of the chamber 162 to increase. The increase in volume draws fluid from the release valve 105 of the release valve 104 and allows the upper 100 to move to the relaxed state around the wearer of the foot. Optionally, the upper 100 may include a locking system which, when activated, locks the geometry of the upper 100 in place once it is in the constricted state.

Figure 7A:
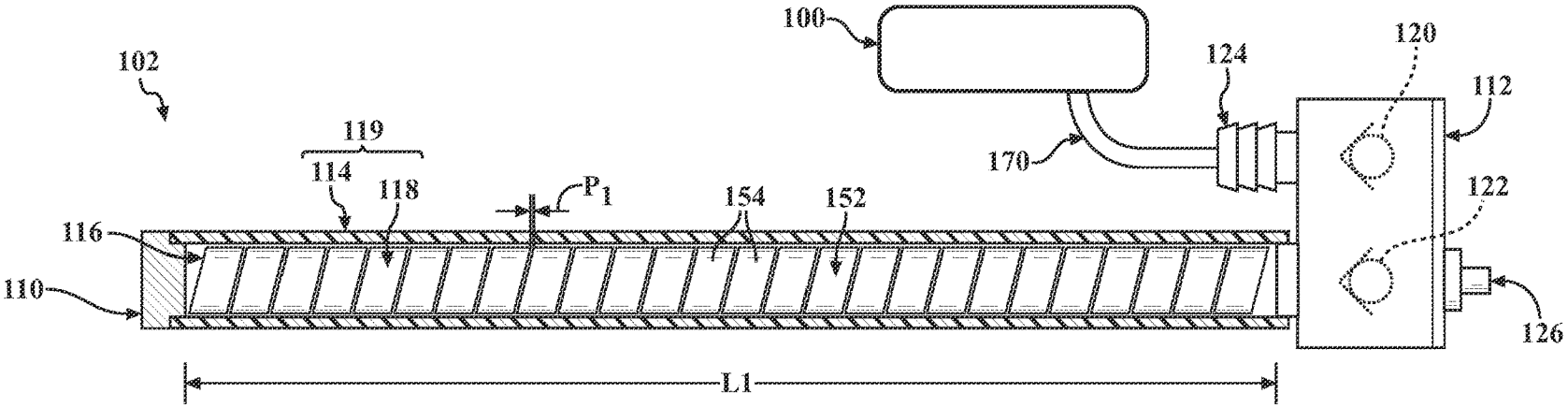
FIG. 7A is an example of the pump of FIG. 2, where the pump is in a first position.
Figure 7B:
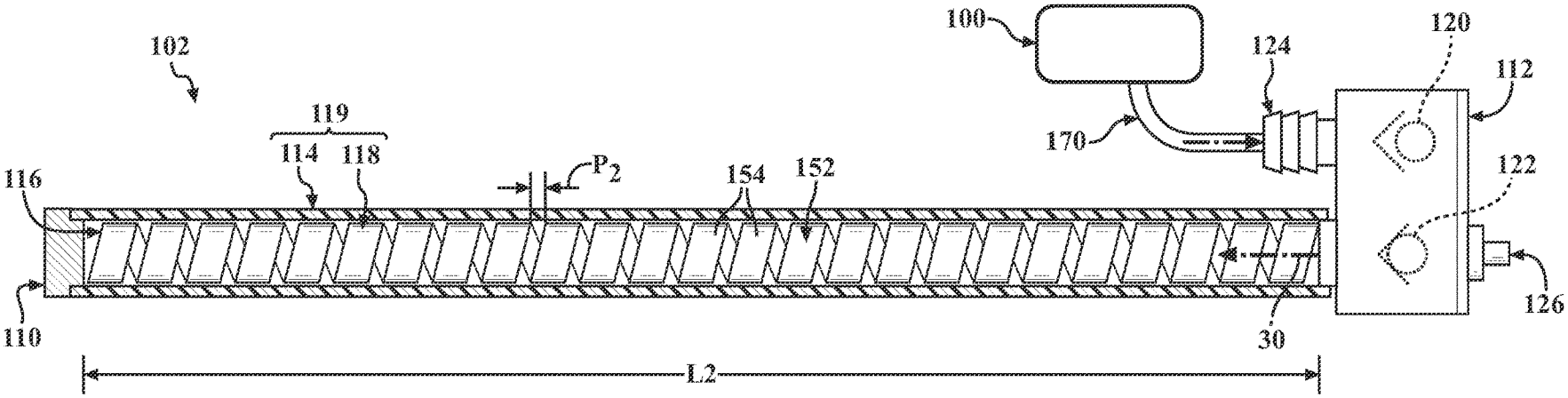
FIG. 7B is an example of the pump of FIG. 2, where the pump is in a second position.

With continued reference to FIGS. 7A-7B, the upper 100 may be transitioned between the relaxed state and the constricted state via the pump 102. Here, a vacuum may be drawn by pulling the actuator cable 119 in the tightening direction 148 (i.e., moving the cable 119 away from the upper 100) and releasing the actuator cable 119 for a number of cycles. As the actuator cable 119 is pulled in the tightening direction, the outer tube 114 and the coil 118 are moved from the first position (FIG. 7A) associated with the first length L1 to the second position (FIG. 7B) associated with the second length L2. Concurrently, the coil pitch P extends from the first coil pitch P1 associated with the first length L1 to the second coil pitch P2 associated with the second length L2, thereby creating space between the threads 154 of the coil 118 and creating a vacuum drawing fluid 30 from the upper 100 into the chamber 116 via the intake port 124 and the inlet check valve 120. Once the actuator cable 119 is in the second position, the inlet check valve 120 closes to prevent the fluid 30 from escaping the chamber 116 back into the chambers 162 of the upper 100.

When the actuator cable 119 is released, the resiliency of the outer tube 114 and the coil 118 bias the actuator cable 119 from the second position (FIG. 7B) associated with the second length L2 to the first position (FIG. 7C) associated with the first length L1, decreasing the coil pitch P from the second coil pitch P2 to the first coil pitch P2 and exhausting the fluid 30 within the chamber 116 through the exhaust check valve 126 and the exhaust check valve 122. Thus, the fluid 30 drawn from the chambers 162 when the actuator cable 119 moves from the first position to the second position is exhausted from the pump 102 when the outer tube 114 and the coil 118 return from the second position to the first position. Accordingly, the steps of pulling the actuator cable 119 in the tightening direction 148 followed by releasing the actuator cable 119 constitutes a cycle. For each cycle that the actuator cable 119 is pulled in the tightening direction 118 and released, the pressure within the upper 100 is incrementally reduced. In some examples, the pressure within the upper 100 reaches an ideal pressure to constrict the upper 100 (e.g., −5 psi) after three pulls on the actuator cable 119. In other examples, fewer or more pulls on the actuator cable 119 are required.

While not shown, when the wearer wishes to move the upper 100 to the relaxed state, the wearer increases the pressure within the chambers 162 of the upper 100 by pressing the release valve 104 of the release valve 105. Specifically, the wearer may press the release valve 104 located on the outer surface of the sole structure 200, which biases the release valve 105 to an open position to allow ambient air to flow within the chambers 162 of the upper 100. Consequently, the pressure within the chambers 162 of the upper 100 increases, and the upper 100 transitions from the constricted state (FIG. 1B) to the relaxed state (FIG. 1A) around the wearer's foot.

Figure 8A:
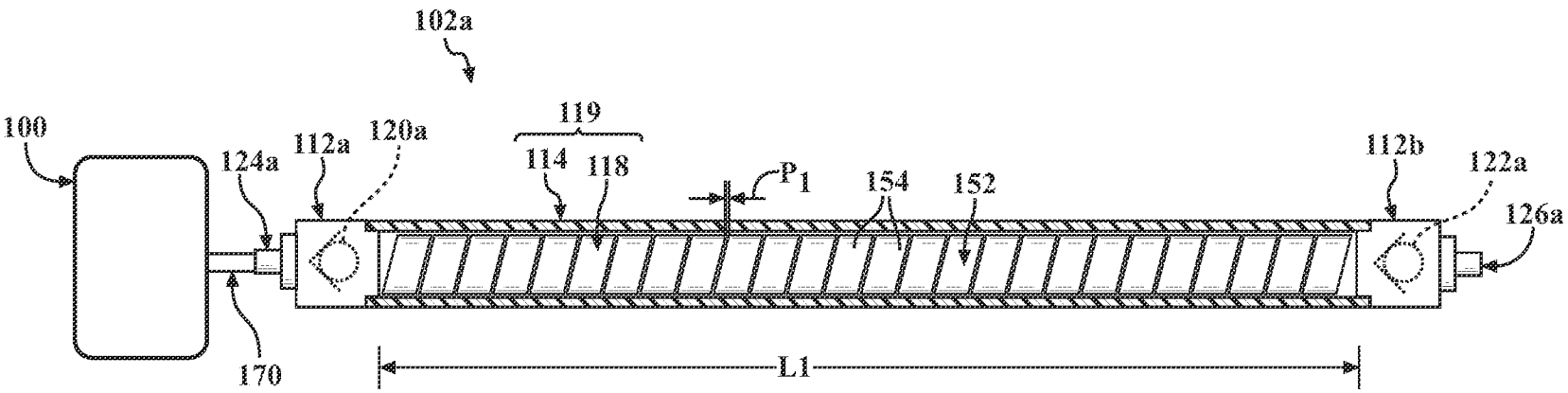
FIG. 8A is an example of a pump according to the present disclosure, where the pump is in a first position.
Figure 8B:
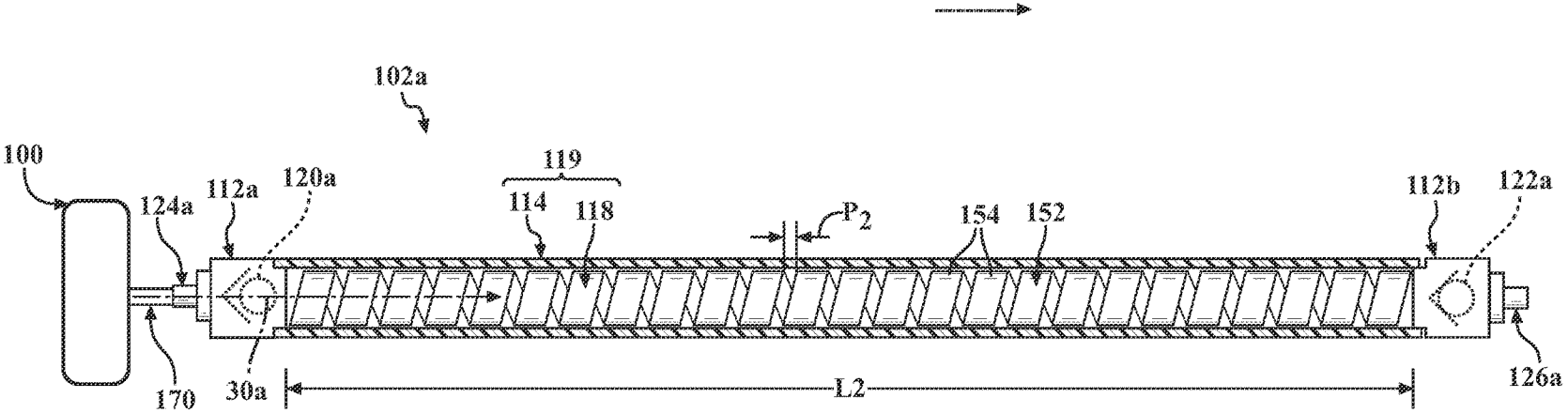
FIG. 8B is an example of the pump of FIG. 8A, where the pump is in a second position.
Figure 8C:
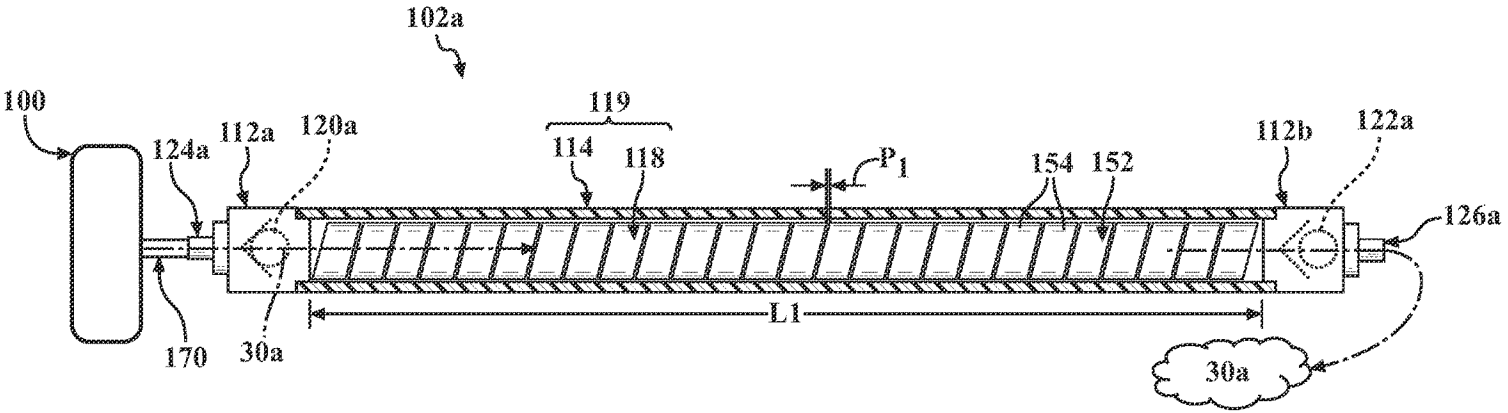
FIG. 8C is an example of the pump of FIG. 8A, where the pump is in the first position.

With particular reference to FIGS. 8A-8C, another example of a configuration of a pump 102*a* is shown. In view of the substantial similarity in structure and function of the components associated with the pump 102 with respect to the pump 102*a*, like reference numerals are used hereinafter and in the drawings to identify like components while like reference numerals containing letter extensions are used to identify those components that have been modified.

Figure 7C:
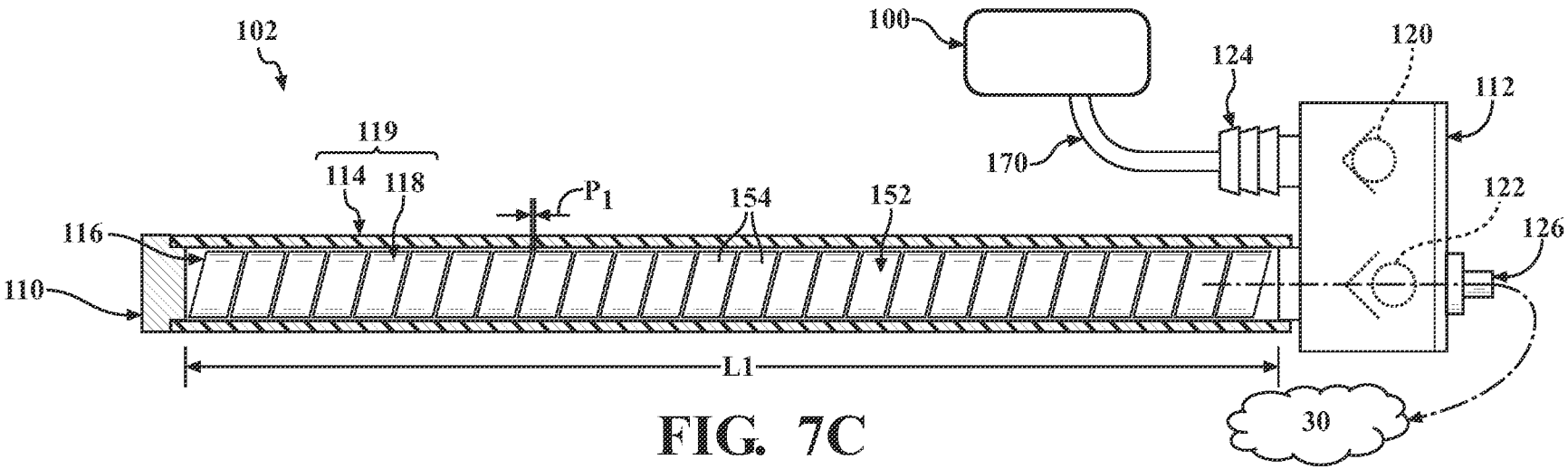
FIG. 7C is an example of the pump of FIG. 2, where the pump is in the first position.

The pump 102*a* includes the actuator cable 119 including the outer tube 114 and the coil 118 with respect to FIGS. 7A-7C, but includes an alternate arrangement of check valves. Here, the pump 102*a* includes a first manifold 112*a* disposed on the first end 106 and including an inlet check valve 120*a* and a second manifold 112*b* disposed on the second end 108 and including an outlet check valve 122*a*. Accordingly, the inlet check valve 120*a* and the outlet check valve 122*a* are inline, as shown in FIGS. 8A-8C. A vacuum may be drawn by pulling the actuator cable 119 in the tightening direction 148 and releasing the actuator cable 119 for a number of cycles. As the actuator cable 119 is pulled in the tightening direction, the outer tube 114 and the coil 118 are moved from the first position (FIG. 8A) associated with the first length L1 to the second position (FIG. 8B) associated with the second length L2. Concurrently, the coil pitch P extends from the first coil pitch P1 associated with the first length L1 to the second coil pitch P2 associated with the second length L2, thereby creating space between the threads 154 of the coil 118 and creating a vacuum drawing fluid 30*a* from the upper 100 into the chamber 116 via an intake port 124*a* and the inlet check valve 120*a* disposed on the first end 106 of the pump 102*a*. Once the actuator cable 119 is in the second position, the inlet check valve 120*a* closes to prevent the fluid 30*a* from escaping the chamber 116 back into the chambers 162 of the upper 100.

When the actuator cable 119 is released, the resiliency of the outer tube 114 and the coil 118 bias the actuator cable 119 from the second position (FIG. 7B) associated with the second length L2 to the first position (FIG. 7C) associated with the first length L1, decreasing the coil pitch P from the second coil pitch P2 to the first coil pitch P1 and exhausting the fluid 30 within the chamber 116 through an exhaust check valve 126*a* and the exhaust check valve 122*b* disposed on the second end 108 of the pump 102*a*. Thus, the fluid 30*a* drawn from the chambers 162 when the actuator cable 119 moves from the first position to the second position is exhausted from the pump 102*a* when the outer tube 114 and the coil 118 return from the second position to the first position.

While not shown, the inlet check valves 120, 120*a* and the exhaust check valves 122, 122*a* may be flipped directions to create a pump 102 that creates positive pressure (i.e., creates pressure in the upper 100) rather than negative pressure (i.e., pulls a vacuum in the upper 100).

Figure 9B:
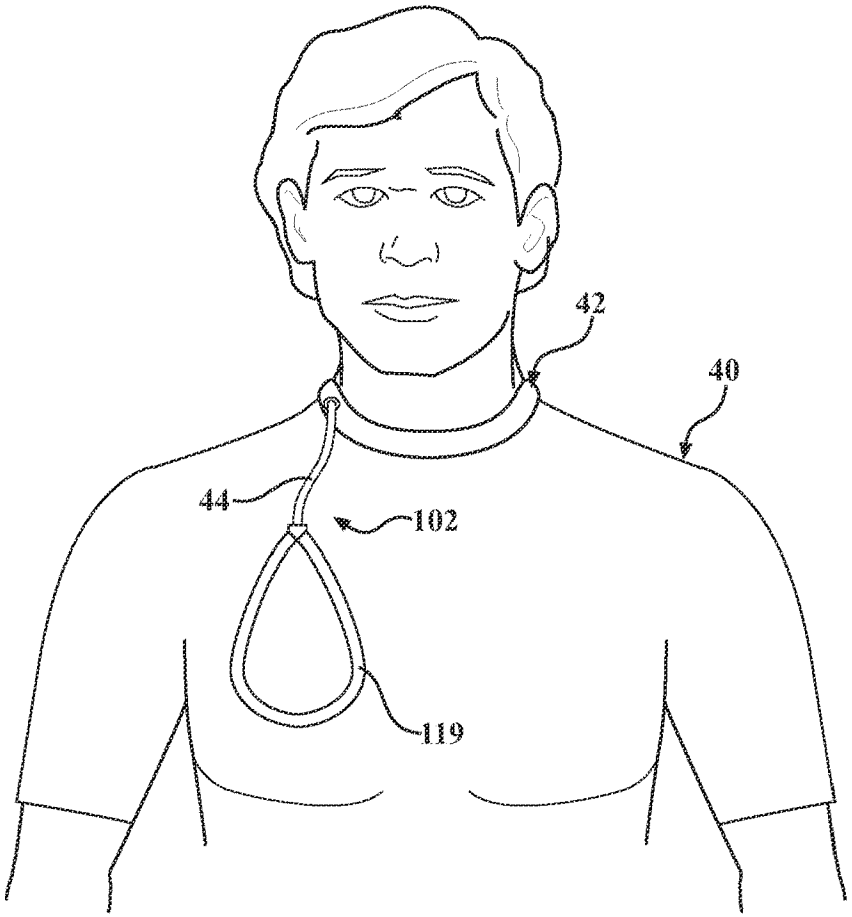
FIG. 9B is a perspective view of the article of clothing of FIG. 9A, where the article of clothing is in a constricted state.
Figure 9A:
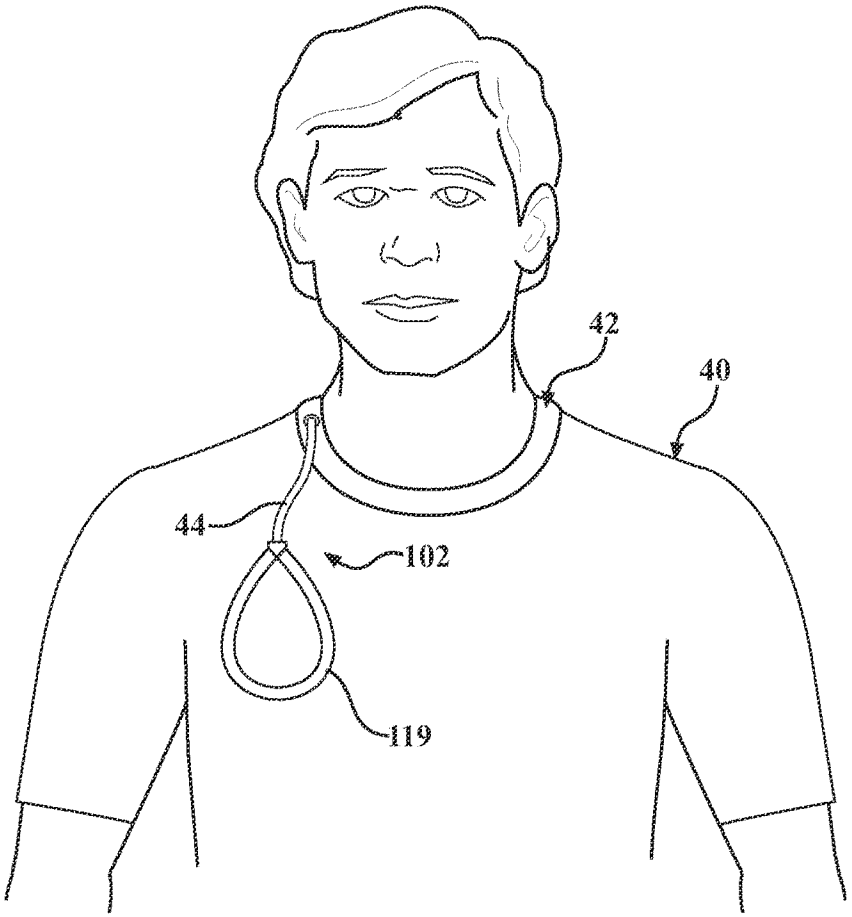
FIG. 9A is a perspective view of an article of clothing incorporating a pump according to an example of the present disclosure, where the article of clothing is in a relaxed state.

Referring to FIGS. 9A and 9B, the pump 102 may be incorporated into an article of apparel such as shirt 40. In this example, the shirt 40 may include one or more fluid-filled chambers 42 in fluid communication with the pump 102. As discussed with reference to FIGS. 1A and 1B, the chambers 42 may include a compressible component disposed therein which compresses as the shirt 40 transitions from a relaxed state (FIG. 9A) to a constricted state (FIG. 9B). In these implementations, an intake conduit 44 connects the pump 102 to the chambers 42 of the shirt 40 allowing fluid communication between the pump 102 and the shirt 40.

In use, the shirt 40 begins in the relaxed state (FIG. 9A), and the wearer actuates the pump 102 by moving the actuator cable 119 from the first position to the second position thereby creating a vacuum drawing fluid from the shirt 40 into the chamber 116 of the pump 102. Once the actuator cable 119 is in the second position, the inlet check valve 120 closes to prevent the fluid from escaping the chamber 116 back into the chambers 42 of the shirt 40.

When the actuator cable 119 is released, the resiliency of the outer tube 114 and the coil 118 biases the actuator cable 119 from the second position to the first position and exhausting the fluid 30 within the chamber 116 through the exhaust check valve 126 and the exhaust check valve 122. Thus, the fluid 30 drawn from the chambers 42 when the actuator cable 119 moves from the first position to the second position is exhausted from the pump 102 when the outer tube 114 and the coil 118 return from the second position to the first position. Accordingly, the shirt 40 moves from a relaxed state to a constricted state around the wearer's body.

The following Clauses provide an exemplary configuration for a pump for an article of footwear or apparel described above.

Clause 1. A pump comprising a conduit defining an inner volume and formed from a flexible material, the conduit movable between an expanded state and a relaxed state, a coil disposed within the conduit and including an outer diameter that is approximately equal to an inner diameter of the conduit, the coil substantially maintaining its outer diameter when the conduit is moved between the relaxed state and the expanded state, and a manifold in fluid communication with the inner volume and operable to permit fluid to enter the inner volume in a first mode and expel fluid from the inner volume in a second mode.

Clause 2. The pump of Clause 1, wherein the coil is formed from a different material than a material forming the conduit.

Clause 3. The pump of Clause 1, wherein the coil is formed from a foam material.

Clause 4. The pump of Clause 1, wherein the coil has a helical shape.

Clause 5. The pump of Clause 4, wherein the coil defines a passageway formed therethrough.

Clause 6. The pump of Clause 5, wherein the passageway includes a longitudinal axis that is substantially parallel to a longitudinal axis of the coil.

Clause 7. The pump of Clause 1, wherein the manifold includes a first valve permitting fluid flow into the inner volume and preventing fluid flow out of the inner volume in the first mode and a second valve permitting fluid flow out of the inner volume and preventing fluid flow into the inner volume in the second mode.

Clause 8. The pump of Clause 7, wherein at least one of the first valve and the second valve is a check valve.

Clause 9. An article of footwear incorporating the pump of Clause 1.

Clause 10. An article of apparel incorporating the pump of Clause 1.

Clause 11. A pump comprising a conduit defining an inner volume and movable between an expanded state and a relaxed state, an effective length of the conduit being increased when moved from the relaxed state to the expanded state, a coil disposed within the conduit, including an outer diameter that is approximately equal to an inner diameter of the conduit, and having an effective length that is increased when the conduit is moved from the relaxed state to the expanded state, the coil substantially maintaining its outer diameter when the conduit is moved between the relaxed state and the expanded state, and a manifold in fluid communication with the inner volume and operable to permit fluid to enter the inner volume in a first mode and expel fluid from the inner volume in a second mode.

Clause 12. The pump of Clause 11, wherein the coil is formed from a different material than a material forming the conduit.

Clause 13. The pump of Clause 11, wherein the coil is formed from a foam material.

Clause 14. The pump of Clause 11, wherein the coil has a helical shape.

Clause 15. The pump of Clause 14, wherein the coil defines a passageway formed therethrough.

Clause 16. The pump of Clause 15, wherein the passageway includes a longitudinal axis that is substantially parallel to a longitudinal axis of the coil.

Clause 17. The pump of Clause 11, wherein the manifold includes a first valve permitting fluid flow into the inner volume and preventing fluid flow out of the inner volume in the first mode and a second valve permitting fluid flow out of the inner volume and preventing fluid flow into the inner volume in the second mode.

Clause 18. The pump of Clause 17, wherein at least one of the first valve and the second valve is a check valve.

Clause 19. An article of footwear incorporating the pump of Clause 11.

Clause 20. An article of apparel incorporating the pump of Clause 11.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A pump comprising:

a conduit defining an inner volume and formed from a flexible material, the conduit movable between an expanded state and a relaxed state;

a coil disposed within the conduit, substantially filling the conduit, and including an outer diameter that is approximately equal to an inner diameter of the conduit, the coil substantially maintaining its outer diameter and the inner diameter of the conduit when the conduit is moved between the relaxed state and the expanded state; and a manifold in fluid communication with the inner volume and operable to permit fluid to enter the inner volume in a first mode and expel fluid from the inner volume in a second mode.

2. The pump of claim 1, wherein the coil is formed from a different material than a material forming the conduit.

3. The pump of claim 1, wherein the coil is formed from a foam material.

4. The pump of claim 1, wherein the coil has a helical shape.

5. The pump of claim 4, wherein the coil defines a passageway formed therethrough.

6. The pump of claim 5, wherein the passageway includes a longitudinal axis that is substantially parallel to a longitudinal axis of the coil.

7. The pump of claim 1, wherein the manifold includes a first valve permitting fluid flow into the inner volume and preventing fluid flow out of the inner volume in the first mode and a second valve permitting fluid flow out of the inner volume and preventing fluid flow into the inner volume in the second mode.

8. The pump of claim 7, wherein at least one of the first valve and the second valve is a check valve.

9. An article of footwear incorporating the pump of claim 1.

10. An article of apparel incorporating the pump of claim 1.

11. A pump comprising:

a conduit defining an inner volume and movable between an expanded state and a relaxed state, an effective length of the conduit being increased when moved from the relaxed state to the expanded state;

a coil disposed within the conduit, substantially filling the conduit, including an outer diameter that is approximately equal to an inner diameter of the conduit, and having an effective length that is increased when the conduit is moved from the relaxed state to the expanded state, the coil substantially maintaining its outer diameter and the inner diameter of the conduit when the conduit is moved between the relaxed state and the expanded state; and a manifold in fluid communication with the inner volume and operable to permit fluid to enter the inner volume in a first mode and expel fluid from the inner volume in a second mode.

12. The pump of claim 11, wherein the coil is formed from a different material than a material forming the conduit.

13. The pump of claim 11, wherein the coil is formed from a foam material.

14. The pump of claim 11, wherein the coil has a helical shape.

15. The pump of claim 14, wherein the coil defines a passageway formed therethrough.

16. The pump of claim 15, wherein the passageway includes a longitudinal axis that is substantially parallel to a longitudinal axis of the coil.

17. The pump of claim 11, wherein the manifold includes a first valve permitting fluid flow into the inner volume and preventing fluid flow out of the inner volume in the first mode and a second valve permitting fluid flow out of the inner volume and preventing fluid flow into the inner volume in the second mode.

18. The pump of claim 17, wherein at least one of the first valve and the second valve is a check valve.

19. An article of footwear incorporating the pump of claim 11.

20. An article of apparel incorporating the pump of claim 11.

* * * * *